United States Patent [19]

Menard et al.

[11] Patent Number: 4,748,957

[45] Date of Patent: Jun. 7, 1988

[54] DEVICE FOR REGULATING A COMBUSTION ENGINE

[75] Inventors: Christian Menard, Maurepas; Daniel Marouby, Viroflay; Eric Faouen, La Celle St Cloud; Jean J. Meuleman, Orsay, all of France

[73] Assignee: Compagnie d'Informatique Militaire Spatiale et Aeronautique, Paris, France

[21] Appl. No.: 937,291

[22] Filed: Dec. 3, 1986

[30] Foreign Application Priority Data

Dec. 6, 1985 [FR] France ..... 85 18113

[51] Int. Cl.[4] ..... F02M 51/00

[52] U.S. Cl. ..... 123/489; 123/352; 123/478

[58] Field of Search ..... 123/415, 416, 417, 440, 123/478, 489, 589, 418, 340, 361, 357, 350, 352

[56] References Cited

U.S. PATENT DOCUMENTS

| | | | |
|---|---|---|---|
| 3,750,632 | 8/1973 | Zechnall | 123/415 |
| 4,111,178 | 9/1978 | Casey | 123/416 X |
| 4,231,331 | 11/1980 | Suzuki et al. | 123/416 |
| 4,452,207 | 6/1984 | Moore, Jr. | 123/489 X |
| 4,471,741 | 9/1984 | Asik et al. | 123/478 |
| 4,481,908 | 11/1984 | Iida | 123/489 X |

FOREIGN PATENT DOCUMENTS 2064171 6/1981 United Kingdom .

OTHER PUBLICATIONS

Jones et al., "Electronic Fuel Injection: Diesels Are Next," *IEEE*, vol. 18, No. 5, May 1981, pp. 30–34.

*Primary Examiner*—Willis R. Wolfe, Jr.

*Attorney, Agent, or Firm*—Pollock, VandeSande & Priddy

[57] ABSTRACT

A device is provided for regulating a combustion engine whose operation is governed by a set of parameters $P_i$ ($1 \leqq i \leqq n$), including essentially an assembly of "m" regulation loops for regulating "m" parameters (with $m \leqq n$), a set of "q" sensors (with $q=n-m$) for measuring the parameters which are possibly not regulated and a regulator common to the assembly of these "m" loops, for providing, from the different references and the values detected by the different sensors, a signal controlling the different actuators so as to ensure the evolution of each of the regulated parameters, in connection with the evolution of all or part of the other parameters, regulatable or not, regulated or not and for maintaining the engine at all times in a condition of optimum operation.

4 Claims, 4 Drawing Sheets

FIG_2-a
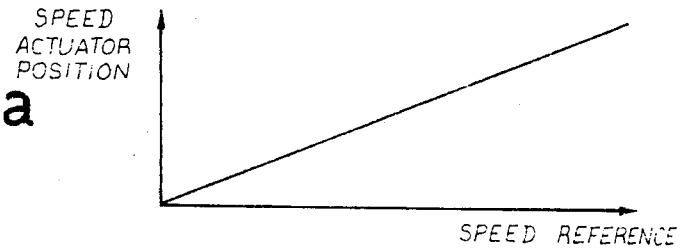
FIG_2-b
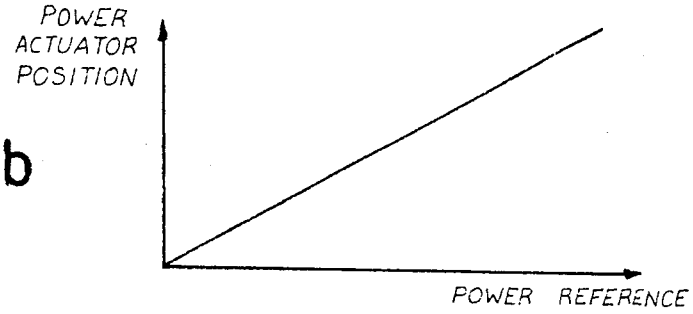
FIG_2-c
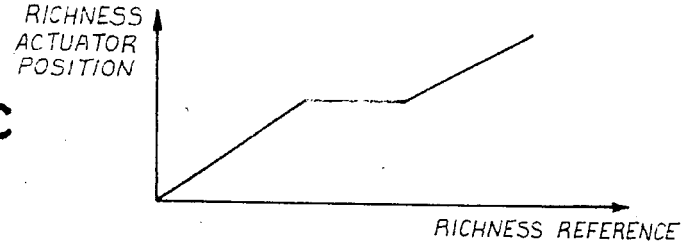
FIG_2-d
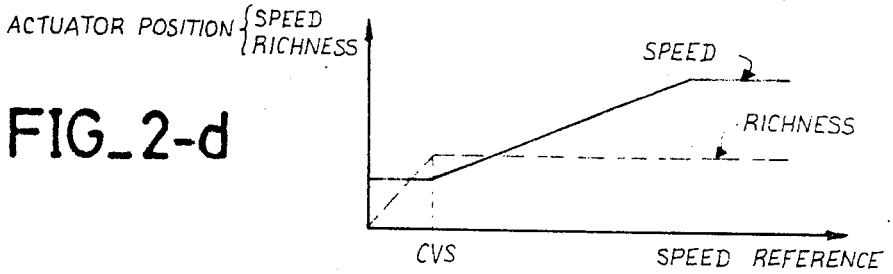
FIG_2-e
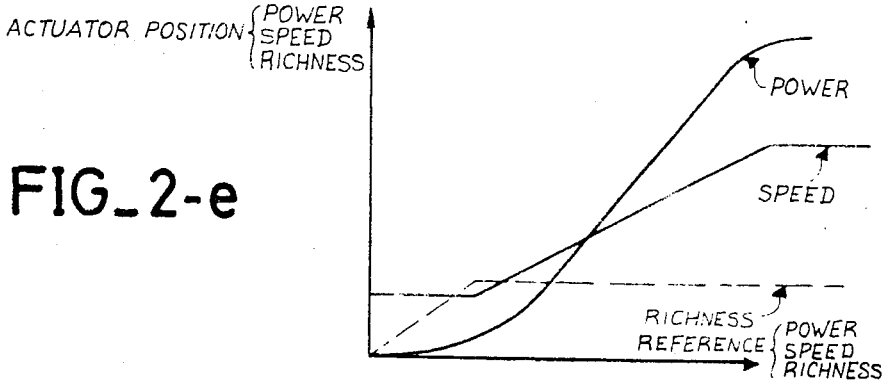

DEVICE FOR REGULATING A COMBUSTION ENGINE

BACKGROUND OF THE INVENTION

1. Field of the Invention

The present invention relates to the regulation of combustion engines.

A combustion engine, for example a petrol or diesel engine, may be considered as a complex system whose operation is governed by a certain number of parameters, such as air flow, gas-oil flow, air temperature, air pressure, speed of the engine power . . . etc 2. Description of the Prior Art Present regulation devices are generally adapted for providing either a single regulation function, such as speed regulation, flow regulation or richness regulation . . . etc, or several regulation functions, but totally independently of each other.

These devices have the drawback of causing each of the parameters to evolve completely independently of the others. Now, these different parameters interact with each other all the more closely since the engine is complex and is defined by a large number of parameters.

SUMMARY OF THE INVENTION

The present invention provides a regulation device for carrying out different types of regulation while taking into account the interactions between the different parameters, and so for maintaining the engine at all times in an optimum operating condition, whence more particularly optimum efficiency and an improved lifespan.

According to the invention,a device for regulating a combustion engine, whose operation is governed by a set of parameters $P_i$ ($1 \leqq i \leqq n$), essentially comprises:

- an assembly of "m" regulation loops, for regulating "m" parameters (with $m \leqq n$), each comprising more particularly one or more reference input devices, one or more actuators for acting on the engine so as to modify the value of the corresponding parameter or parameters and one or more sensors for measuring the value of the parameter or parameters thus modified;
- an assembly of "q" sensors (with $q=n-m$) for measuring parameters which are possibly not regulatable;
- a regulator common to the assembly of these "m" loops, for elaborating, from the different references and the values detected by the different sensors, a signal for controlling the different actuators so as to ensure the evolution of each of the regulated parameters, in connection with the evolution of all or part of the other parameters, whether they are regulatable or not, regulated or not.

BRIEF DESCRIPTION OF THE DRAWINGS

Other objects and features of the present invention will be clearer from reading the following description, of one embodiment, with reference to the accompanying drawings in which.

Figure 3:
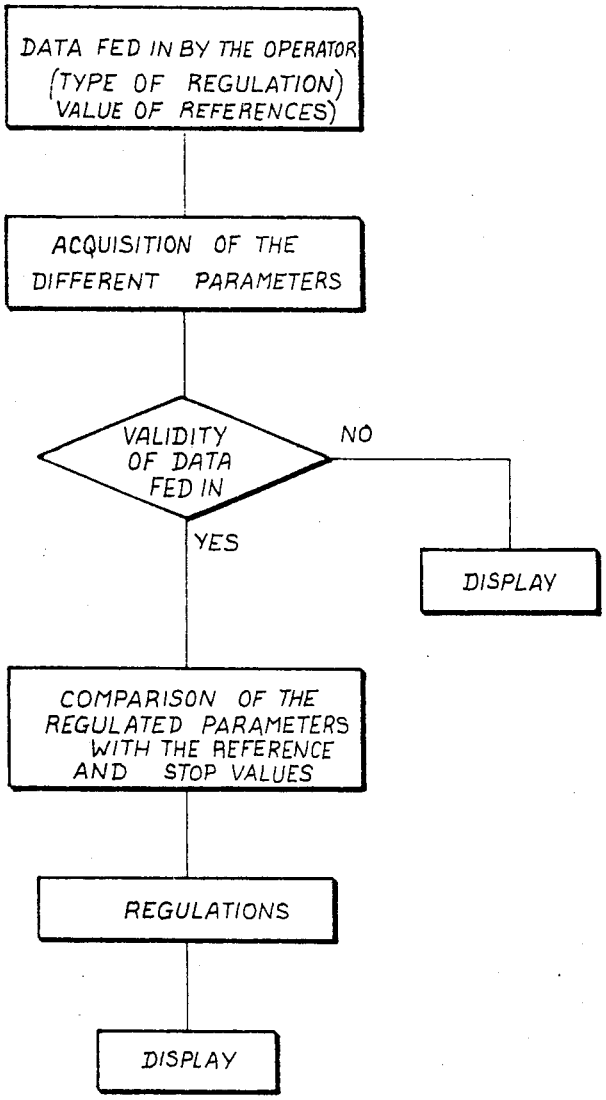
Figure 4:
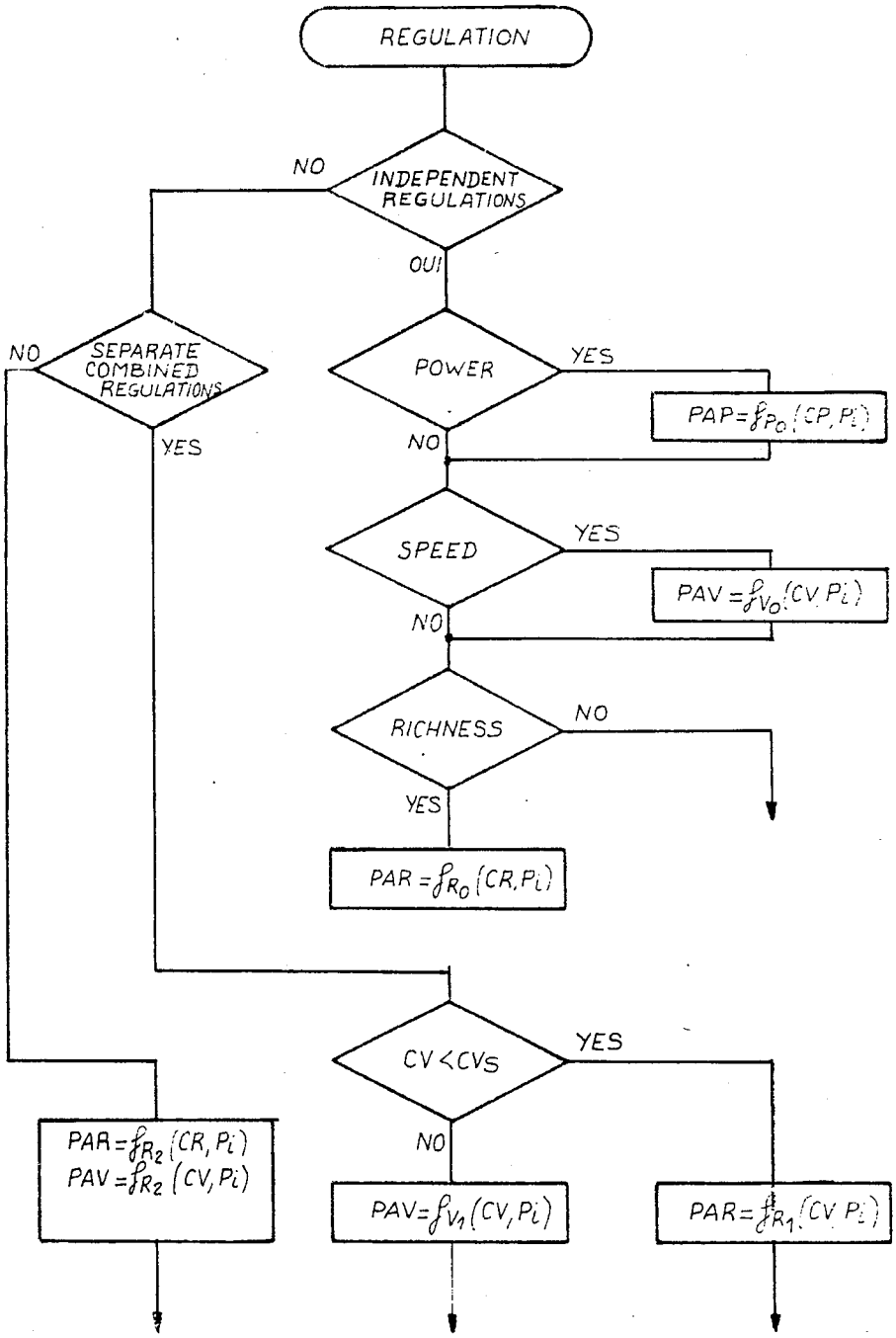

FIGS. *2a*, *2b*, *2c*, *2d* and *2e* are examples of curves relative to different types of regulation able to be implemented by the regulation device of the invention;

FIG. 3 is one example of a general flow chart of operation of the device of the invention; and FIG. 4 shows in greater detail one embodiment of the regulation phase properly speaking, intervening in the flow chart of FIG. 3.

DESCRIPTION OF THE PREFERRED EMBODIMENT

Figure 1:
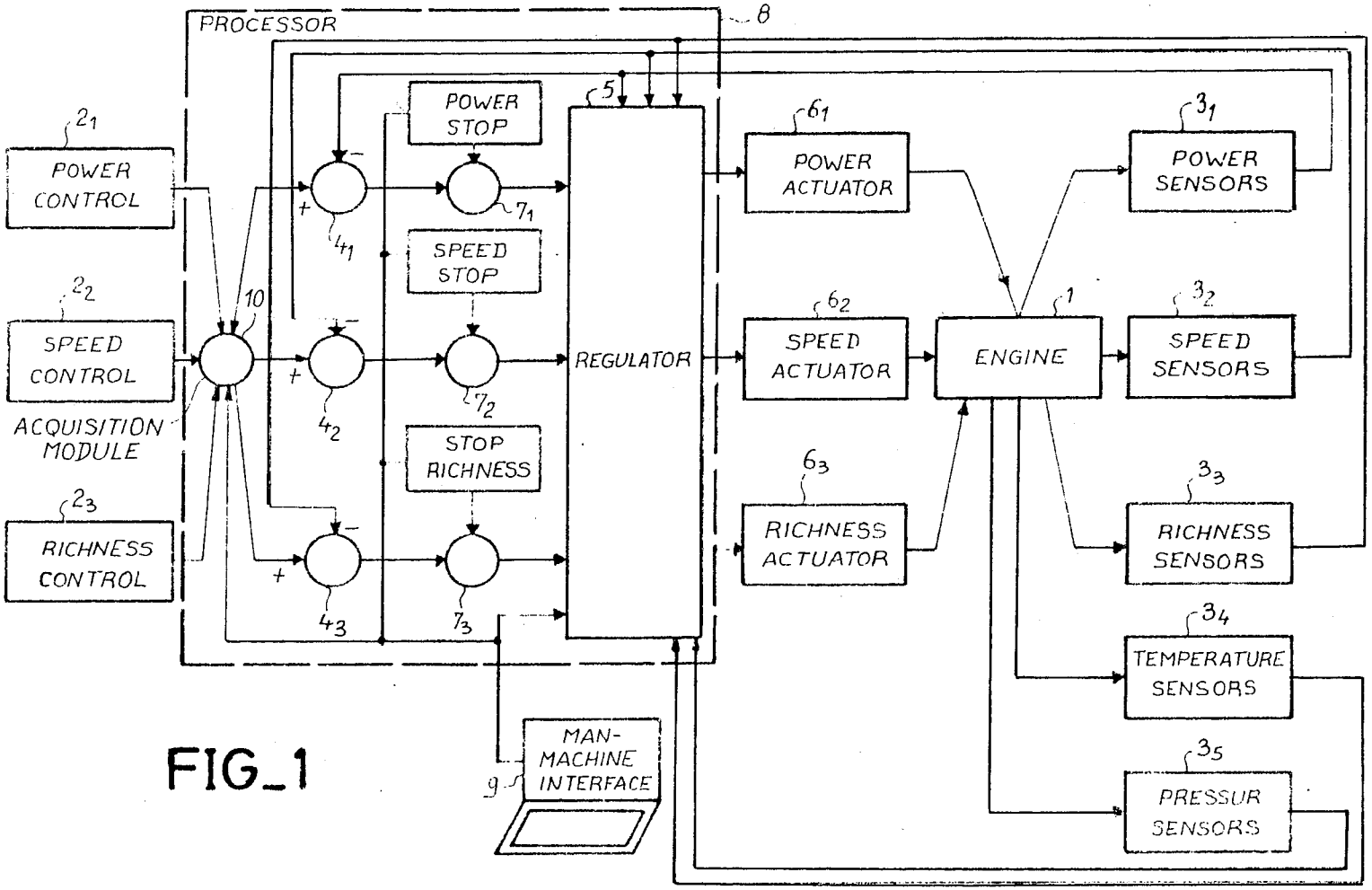
FIG. 1 is a diagram of a regulation device according to the invention.

In the example shown in FIG. 1, the regulation of an engine 1 is provided by means of three regulation loops for providing power regulation, speed regulation and richness regulation.

Each of these loops includes in a way known per se:

- a control device, allowing the operator to fix the value of the reference, respectively the power reference: $2_1$, speed reference: $2_2$ and richness reference: $2_3$;
- a sensor, respectively a power sensor: $3_1$, speed sensor: $3_2$, and a richness sensor: $3_3$;
- a device for comparing the reference and the corresponding magnitude measured by the sensor, respectively $4_1$, $4_2$, and $4_3$;
- an actuator, respectively a power actuator: $6_1$, a speed actuator: $6_2$ and a richness actuator $6_3$, acting on the corresponding parameters of the engine.

The device of the invention also includes a regulator 5 which is common to the assembly of regulation loops and allows different types of regulation to be carried out while taking into account the interactions between the different parameters.

This regulator 5 receives the output signals from the different comparison devices $4_1$, $4_2$, $4_3$, as well as the signals from sensors $3_4$ and $3_5$ for example for acquiring certain parameters not regulatable by means of this device, such as temperature and pressure, and delivers the input signals of the different actuators.

There are also provided, between the three comparators $4_1$, $4_2$, and $4_3$ and the regulator 5 a set of three other comparators, respectively $7_1$, $7_2$, $7_3$ for comparing the parameters relating to each of the regulation loops, namely power, speed and richness, with three extreme values called power stop, speed stop and richness stop so as to ensure operation of the engine below these extreme values.

A module 10 provides acquisition of the different references or controls, the processing and filtering thereof so as to make them usable by the comparators and the regulator. Respective operations for weighting the references are also carried out, in accordance with the parameters recorded by the man-machine interface 9.

The assembly formed by this module 10, by the different comparators and by the regulator 5 is in fact formed by a processor 8 which is programmed in a way which will be described subsequently, with reference to FIGS. 3 and 4, so as to carry out different types of regulations such as those described now, by way of example, with reference to FIGS. *2a* to *2e*, the selection between these different types of regulation being made by the operator by means of a man-machine interface 9 which communicates with the processor 8.

With the device of the invention, for example, speed, richness and power regulations may be carried out either independently or in a combined way, simultaneously or separately.

As far as the independent regulations are controlled, three cases are possible:

a speed regulation: the regulator generates a law for controlling the speed actuator as a function of the speed reference. such as the one shown by way of example in FIG. 2*a*, so as to ensure evolution or maintenance of the speed of the engine in connection with the evolution or maintenance of the reference speed (for example accelerator), the other parameters possibly bringing corrections.

The position of the speed actuator "PAV", may thus be written in the form of a certain function $f_{V0}$ of the speed reference $C_V$ and of the other parameters $P_i$:

$$PAV=f_{V0}(C_V,P_i)$$

with i variable from 1 to n where n is the number of parameters governing the operation of the engine;

a power regulation: the regulator generates a law controlling the power actuator as a function of the power reference, such as that shown by way of example in FIG. 2*b*. The other parameters may bring corrections, which leads to an expression of the position of the power actuator "PAP" in the form of a certain function $f_{p0}$ of the power reference $C_p$ and of the other parameters $P_i$:

$$PAP=f_{P0}(C_p,P_i)$$

a richness regulation: the regulator generates a law controlling the richness actuator as a function of the richness reference, such as that shown by way of example in FIG. 2*c*. The other parameters may bring corrections which leads to an expression of the position of the richness actuator "PAR" in the form of a function of the power reference $C_p$ and the other parameters $P_i$:

$$PAR=f_{R0}(C_R,P_i)$$

In the case of combined but separate regulations, for example speed regulation and richness regulation as shown in FIG. 2*d*, the regulator implements at a given moment a single type of regulation but this type of regulation may evolve in time, as a function of a criterion which is a value of the reference. For example, if the reference (for example the speed reference) is less than a threshold value $C_{VS}$, the regulator provides for example a richness type of regulation which may be expressed in the form of a certain function $f_{R1}$ of the speed reference $C_V$ and other parameters $P_i$. $PAR=f_{R1}(C_V,P_i)$ and if this reference is greater than the threshold value $C_{VS}$, the regulator provides for example a speed type regulation, which may be expressed in the form of a certain function $f_{V1}$ of the speed reference $C_V$ and of the other parameters $P_i$: $PAV=f_{V1}(C_V,P_i)$ where $f_{V1}$ and $f_{R1}$ may be different functions of the functions $f_{V0}$ and $f_{R0}$ defined above.

In the case of combined and simultaneous regulations (case of FIG. 2*e*), the regulator implements several types of regulation at a given moment (for example speed, power and richness), which may each be expressed in the form of a certain function of the corresponding reference and of all or part of the whole of the other parameters, regulatable or not, regulated or not:

Thus the different expressions:

$$PAR=f_{R2}(C_R,P_i)$$

$$PAV=f_{V2}(C_V,P_i)$$

$$PAP=f_{P2}(C_p,P_i)$$

where $f_{R2}$,$f_{V2}$ and $f_{P2}$ designate functions which may be different from the functions $f_{R0}$,$f_{V0}$,$f_{P0}$,$f_{R1}$,$f_{V1}$ and $f_{P1}$ defined above, are calculated simultaneously, which allows optimum laws to be generated for controlling the different actuators.

The general flow chart of operation of the regulator will now be described with reference to FIG. 3. This flow chart begins by an input of data by the operator: particularly the type of regulation desired (namely independent or combined regulations and, for the case of combined regulations, separately or simultaneously, as defined above) and the values of the associated references. The regulator then proceeds with acquisition of the different parameters of the system, through the different sensors. The regulator then proceeds with checking the validity of the data fed in by the operator, so as to check whether they are compatible with the present state of the different parameters of the system and do not in particular cause operation in a critical zone.

The processor 8 further provides systematic storage of the different parameters covering the operation of the motor, and checks their evolution in time thus providing a predictive diagnosis of breakdowns.

In the case where this data is not compatible with the present state of the system, the operator is warned through the man-machine interface 9. In the opposite case, the information received from the sensors is compared with the different reference and stop values, then the regulation properly speaking is carried out, the operator being kept informed of the values of the different parameters and of the operating state of the system through the manmachine interface 9.

The regulation phase properly speaking is described in the form of a flow chart in FIG. 4. For the sake of simplicity, this flow chart corresponds to the particular examples of regulation described in connection with FIGS. 2*a* to 2*e*. Depending on the type of regulation chosen (independent regulations, separately combined or simultaneously combined regulations), such or such of the formulae defined above in connection with FIGS. 2*a* to 2*e* are applied, with the corresponding values of the references and of the parameters.

The different above defined functions "f" are predetermined as a function of each type of regulation and of the characteristics of the engine.

Furthermore, the different types of regulation described have been given solely by way of examples. There exist of course other possibilities, particularly the possibility of providing for each type of regulation different functions "f" depending on the parameters $P_i$ selected by the operator, or else the possibility of providing types of regulation intermediate to those described (for example independent regulations on certain parameters, combined regulations on other parameters . . . etc).

According to the embodiment which has been described, each regulation loop relative to a given parameter includes a reference input device, a comparator, an actuator and a sensor, all relative to the parameter considered. More generally, there may be an interaction between the different parameters, not only insofar as the formation of the law regulating each of the parameters is concerned, as was seen above, but also insofar as the very construction of each of the regulation loops is concerned, in that each of them may comprise several reference input devices, several comparators, several actuators and several sensors, relative to different parameters, by which a given parameter may be caused to evolve, depending on the desired regulation law, by acting on different parameters and by measuring and comparing different parameters with corresponding reference values.

The device of the invention thus allows regulations to be obtained, in accordance with the optimum control laws of the monovariable or multivariable input-output type related to the parameters governing the operation of the engine.

What is claimed is:

1. A device for regulating a combustion engine whose operation is governed by a set of parameters $P_i$ ($1 \leqq i \leqq n$) where $n \geqq 2$, including:

a set of "m" regulation loops where $m \geqq 2$ for regulating "m" parameters (with $m \leqq n$), and each having more particularly at least one reference input device, at least one actuator, for acting on the engine so as to modify the value of the corresponding parameter or parameters, and at least one sensor for measuring the value of the parameter or parameters thus modified;

a set of "q" sensors (with $q=n-m$) for measuring parameters which are possibly non regulatable;

a regulator common to the whole of these "m" loops for providing, from the different references and the values detected by the different sensors, a signal for controlling the different actuators so as to ensure the evolution of each of the regulated parameters, in connection with the evolution of all or part of the other parameters, whether regulatable or not, regulated or not.

2. A device as claimed in claim 1, wherein said regulator allows several parameters to be regulated simultaneously as a function, for each of these parameters, of the corresponding references and of all or part of the other parameters, whether regulatable or not regulated or not.

3. A device as claimed in claim 1, wherein said regulator allows at all times the regulation of a single parameter, but this latter may vary in time as a function of the value of a given reference.

4. A device as claimed in claim 1, wherein said regulator allows at all times the regulation of a single parameter, as a function of the value of the corresponding reference and of all or part of the other parameters, regulatable or not.

* * * * *